United States Patent [19]

Brine, III et al.

[11] Patent Number: 5,054,790

[45] Date of Patent: Oct. 8, 1991

[54] LACROSSE STICK HEAD

[75] Inventors: William H. Brine, III, Mendon, Mass.; Peter J. Brine, Hanover, N.H.

[73] Assignee: Sports Licensing, Inc., Hanover, N.H.

[21] Appl. No.: 628,492

[22] Filed: Dec. 14, 1990

[51] Int. Cl.[5] ..... A63B 59/02

[52] U.S. Cl. ..... 273/326

[58] Field of Search ..... 273/326

[56] References Cited

U.S. PATENT DOCUMENTS

| | | | |
|---|---|---|---|
| D. 236,737 | 9/1975 | Brine | D34/5 CB |
| D. 263,248 | 3/1982 | Brine | D21/210 |
| D. 263,249 | 3/1982 | Rule | D21/210 |
| D. 286,666 | 11/1986 | Brine | D21/210 |
| 2,039,138 | 4/1936 | Auer | 273/326 |
| 3,473,806 | 10/1969 | Patterson | 273/326 |
| 3,591,178 | 7/1971 | Milligan | 273/326 |
| 3,702,702 | 11/1972 | Hoult | 273/326 |
| 4,657,260 | 4/1987 | Brine | 273/326 |

*Primary Examiner*—William H. Grieb

*Attorney, Agent, or Firm*—Lorusso & Loud

[57] ABSTRACT

A lacrosse stick head comprising a frame and netting attached to the frame, the frame including a throat portion, first and second side walls extending divergently from the throat portion, and a lip portion joined to ends of the side walls remote from the throat portion, the first side wall having structure rendering the first side wall substantially more rigid than the second side wall.

22 Claims, 11 Drawing Sheets

LACROSSE STICK HEAD

BACKGROUND OF THE INVENTION

1. Field of the Invention

This invention relates to lacrosse sticks and is directed more particularly to a lacrosse stick head in which the frame is characterized by a first side wall being substantially more rigid than a second side wall.

2. Description of the Prior Art

Lacrosse sticks include head portions attached to stick handles. The head portion comprises a frame which includes a throat portion, two side walls, and a lip portion. Interiorly of the frame there is disposed a netting which includes a ball pocket.

The frames of lacrosse stick heads are commonly made from plastic materials affording lightness and toughness to the frame. However, a problem that causes some concern in plastic frames is a lack of rigidity in the side to side dimension. Manufacturers have attempted to increase rigidity by increasing the thickness of the frame walls. However, because of weight limitations, increasing thickness of the two side walls has its limitations.

In attempts to provide added rigidity to the frame, flanges have been molded on the outer walls of the frames. U.S. Pat. No. 4,657,260, issued April 14, 1987 in the name of William H. Brine, Jr. illustrates several embodiments of frame side walls provided with flanges on their outer surfaces. While such flanges have improved rigidity, they unfortunately clutter up an otherwise smooth surface adapted for the display of manufacturer's logos and/or team symbols.

In U.S. Ser. No. 07/627,326, filed Dec. 14, 1990, in the names of William H. Brine, III, Peter J. Brine and Klon R. Ervin, there is disclosed a lacrosse stick head having a frame with rib means disposed on the interior of side walls, the rib means serving to strengthen the side walls. In U.S. Ser. No. 07/628,419, filed Dec. 14, 1990, in the names of William H. Brine, III and Peter J. Brine, there is disclosed a lacrosse stick head frame with rib means in the throat portion of the frame serving to increase rigidity, and extending into the side walls.

Attempts to improve rigidity of the frame side walls theretofore have applied the improvements to the two side walls equally. It appears to the inventors herein that such reinforcement of both side walls is not necessary in all instances. The most stressful play of the game, when the frame is subjected to extreme pressures sidewise, is the face-off, in which one side wall is pressed against the playing field. In such instances, if the ground-engaging side wall were sufficiently rigid, it would be acceptable to have less than equal rigidity in the other side wall. Limiting the reinforcing structure to one side wall only allows for any added weight to that one wall to be essentially twice as much as would be added to a single wall if both walls were reinforced equally.

Accordingly, it would be beneficial to have available a lacrosse stick having a frame in which one side wall is substantially more rigid than the other.

SUMMARY OF THE INVENTION

It is, therefore, an object of the invention to provide a lacrosse stick head having a frame in which there are first and second side walls and the first side wall is more rigid than the second side wall.

With the above and other objects in view, as will hereinafter appear, a feature of the present invention is the provision of a lacrosse stick head comprising a frame and netting attached to the frame, the frame comprising a throat portion, first and second side walls extending divergently from the throat portion, and a lip portion joined to ends of the walls remote from the throat portion, the first side wall having structure rendering the first side wall substantially more rigid than the second side wall.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENT

Figure 4:
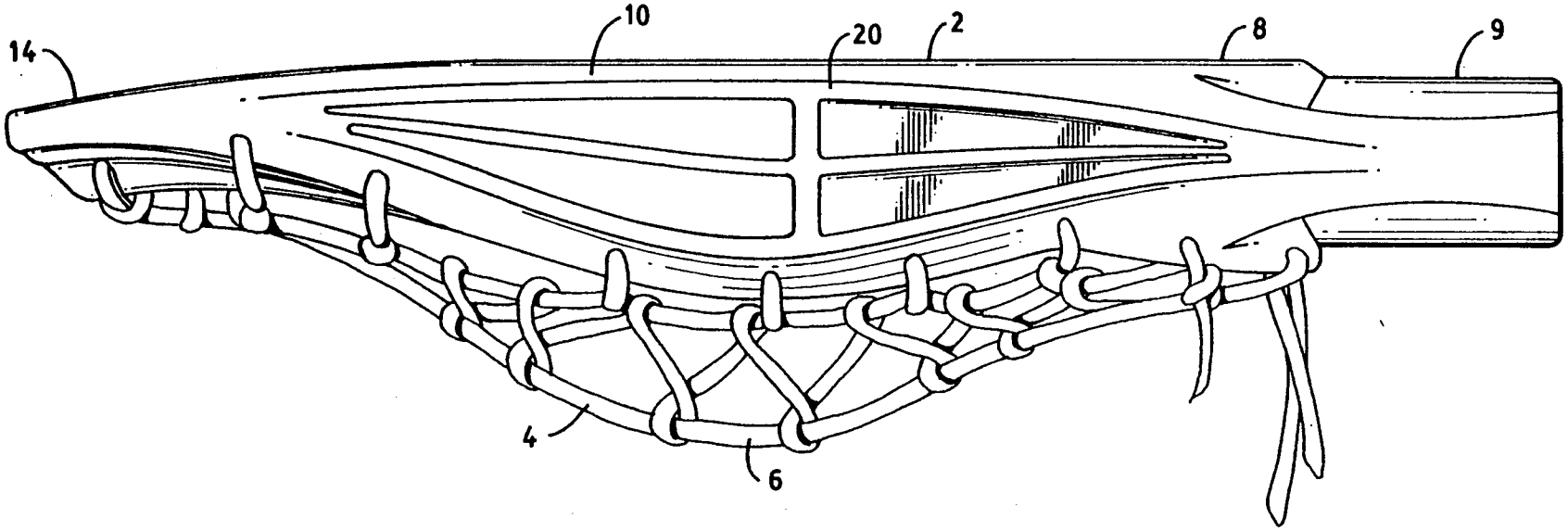
FIG. 4 is a side elevational view of the lacrosse stick head frame shown in FIG. 3, with netting attached.
Figure 6:
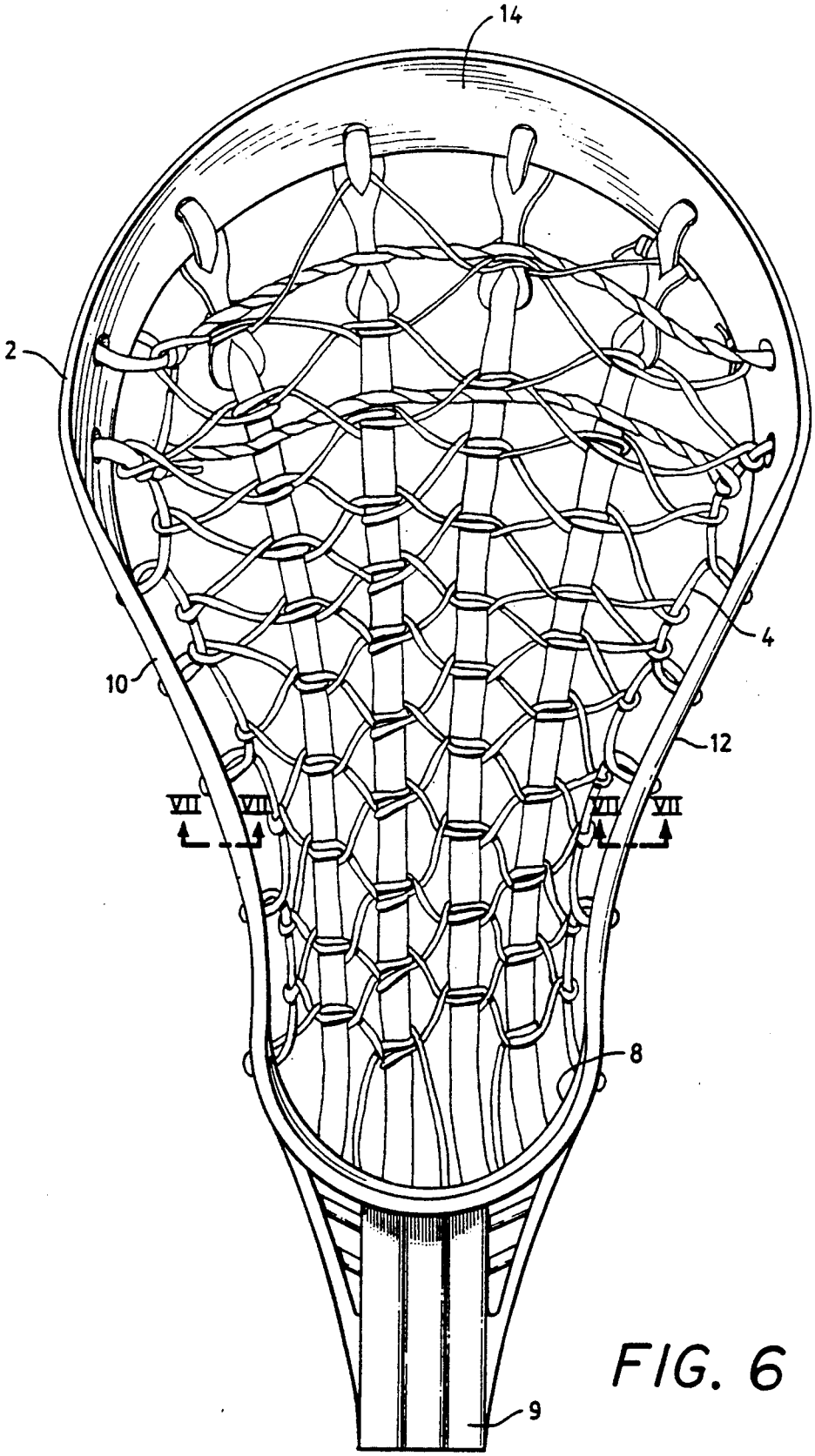
FIG. 6 is a top plan view of a further alternative form of lacrosse stick head frame, shown with netting attached, and illustrative of a further alternative embodiment of the invention.

Referring to the drawings, it will be seen that the lacrosse stick heads described herein include a frame 2 supporting a netting 4 (FIGS. 4 and 6). The netting is configured to provide a ball pocket 6 (FIG. 4). The frame 2 includes a throat portion 8 which has a socket 9 adapted to receive a stick handle (not shown). Extending from the throat portion 8 are first and second side walls 10, 12, which diverge from each other. The ends of the side walls remote from the throat portion join a lip portion 14.

Figure 1:
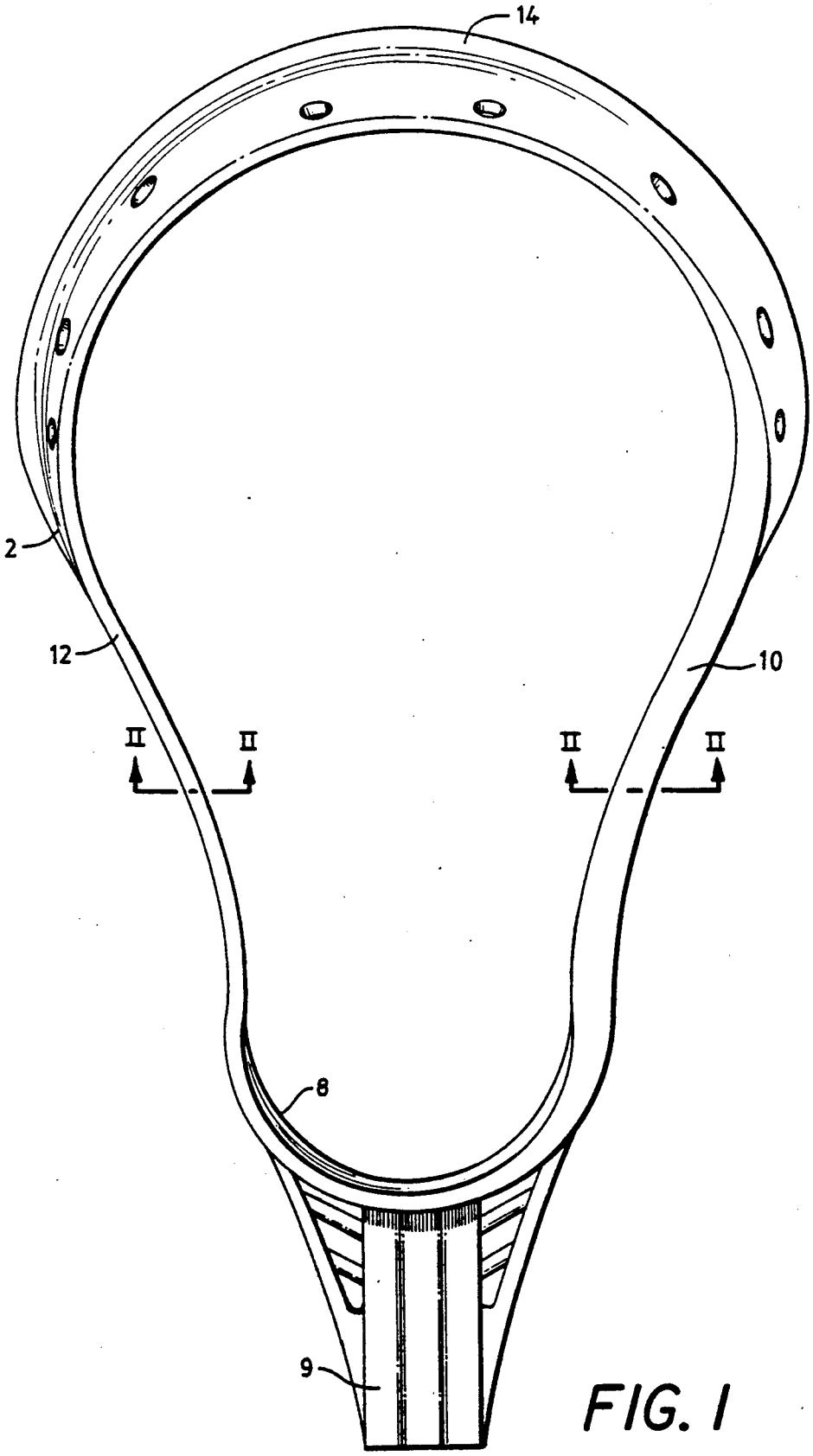
FIG. 1 is a bottom view of one form of lacrosse stick head frame illustrative of an embodiment of the invention.
Figure 2:
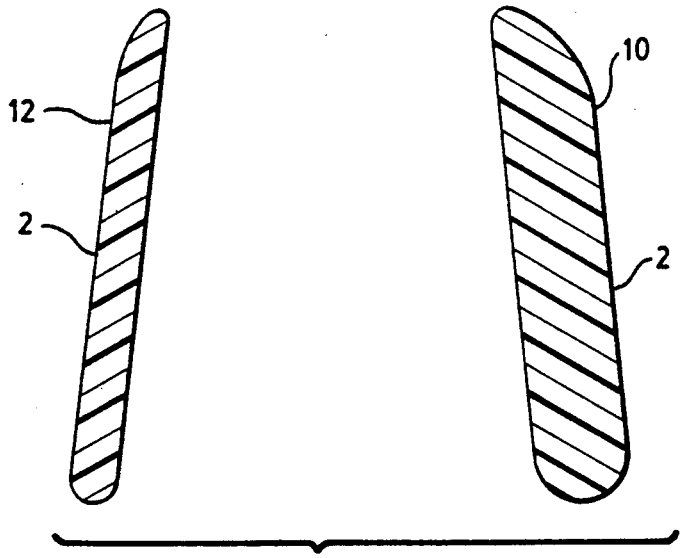
FIG. 2 is a sectional view of side wall portions of the head frame, taken along line II—II of FIG. 1.

In accordance with the present invention, the first side wall 10 is of a more rigid structure than is the second side wall 12. In FIG. 1 there is shown an embodiment in which the first side wall 10 is substantially thicker than the second side wall 12. The difference in thickness are made apparent in FIG. 2, in which the side walls 10, 12 are shown in section. Preferably, the frame 2 is molded and the mold cavity is configured to produce a thicker first wall 10 than second wall 12. The additional thickness renders the first wall substantially more rigid than the second wall and well suited for ground contact in face-off situations.

Figure 3:
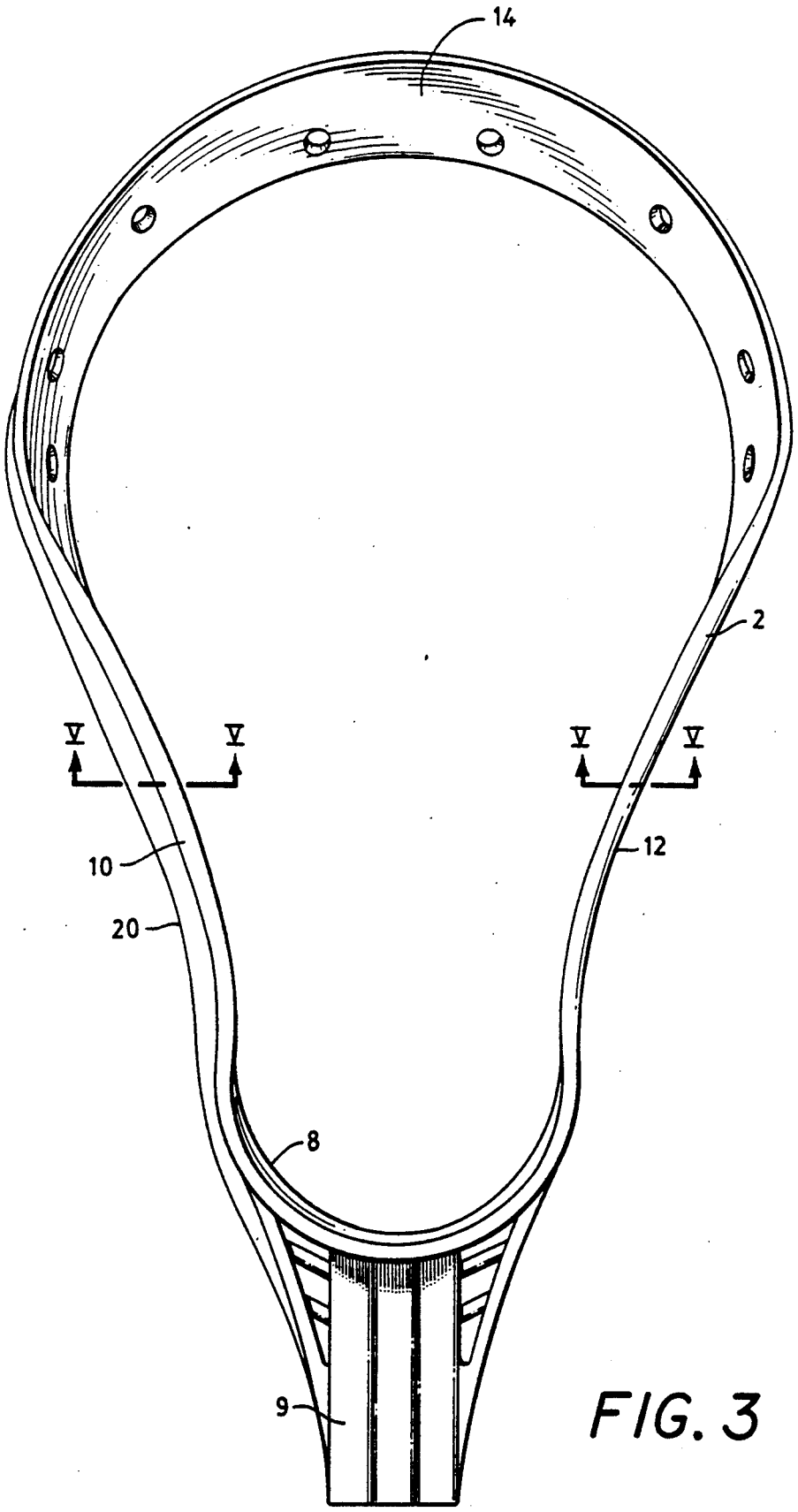
FIG. 3 is a top plan view of an alternative form of lacrosse stick head frame, illustrative of an alternative embodiment of the invention.
Figure 5:
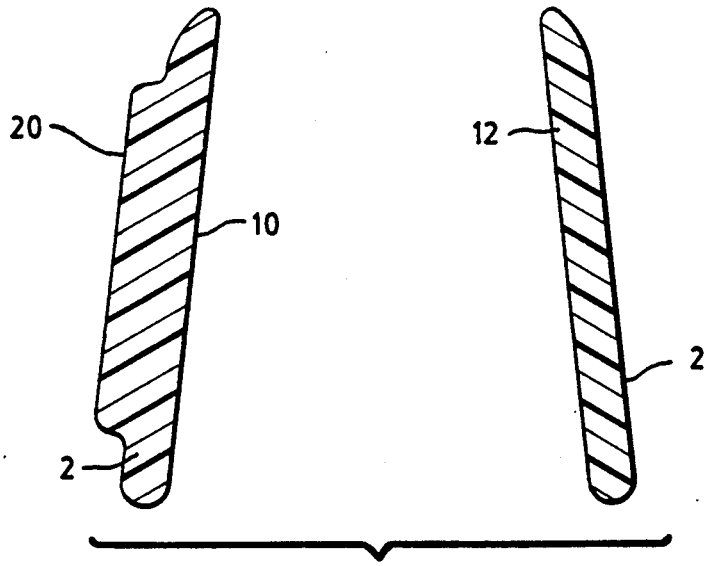
FIG. 5 is a sectional view of side wall portions of the head frame, taken along line V—V of FIG. 3.

In FIGS. 3–5, there is shown an alternative embodiment in which the two side walls 10, 12 are of substantially equal thickness, but by virtue of exterior rib means 20, the first side wall 10 is rendered substantially more rigid than the second side wall 12. In one embodiment, illustrated in FIGS. 3–5, rib means 20 are provided on the first side wall 10, with the second side wall 12 being devoid of rib means. In this embodiment, the second side wall 12 remains uncluttered and adapted to serve as a mounting platform for manufacturer or team logos and symbols. In an alternative embodiment, not shown, both side walls are provided with rib means, but the rib means on the first side wall are of larger size or are more extensive than the rib means on the second side wall, rendering the first side wall more rigid than the second side wall.

Figure 7:
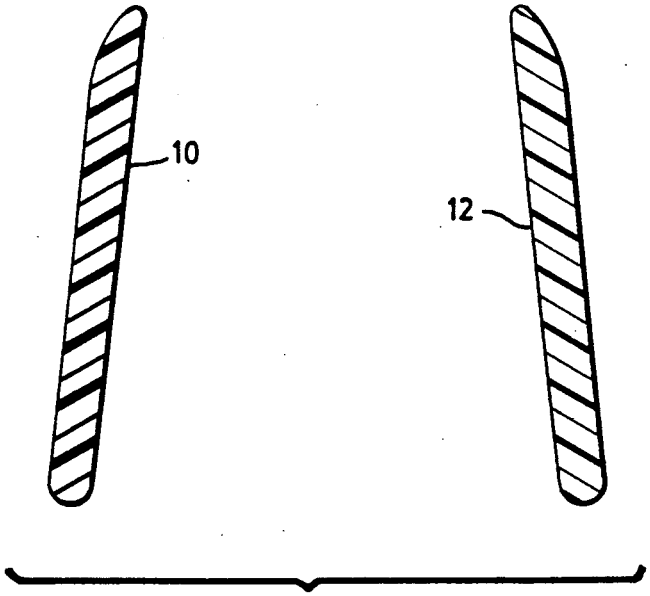
FIG. 7 is a sectional view of side wall portions of the head, taken along line VII—VII of FIG. 6.

FIGS. 6 and 7 illustrate another alternative embodiment, in which the side walls are constructed substantially equal in size and shape, but of different materials. In this embodiment, if the frame is molded, the mold cavity is provided with two inlets, such that different materials may be introduced at either side of the mold, a first more rigid material forming the first side wall 10 and portions of the throat and lip portions, and a second more resilient material forming the second side wall 10 and other portions of the throat and lip portions. Alternatively, one or both side walls may be molded, or otherwise formed, separately and joined to the remainder of the frame mechanically or chemically. In one alternative embodiment, the side walls may be snap fit to the frame, and removed therefrom such that, in the field, the side walls are interchangeable with other side walls.

Figure 8:
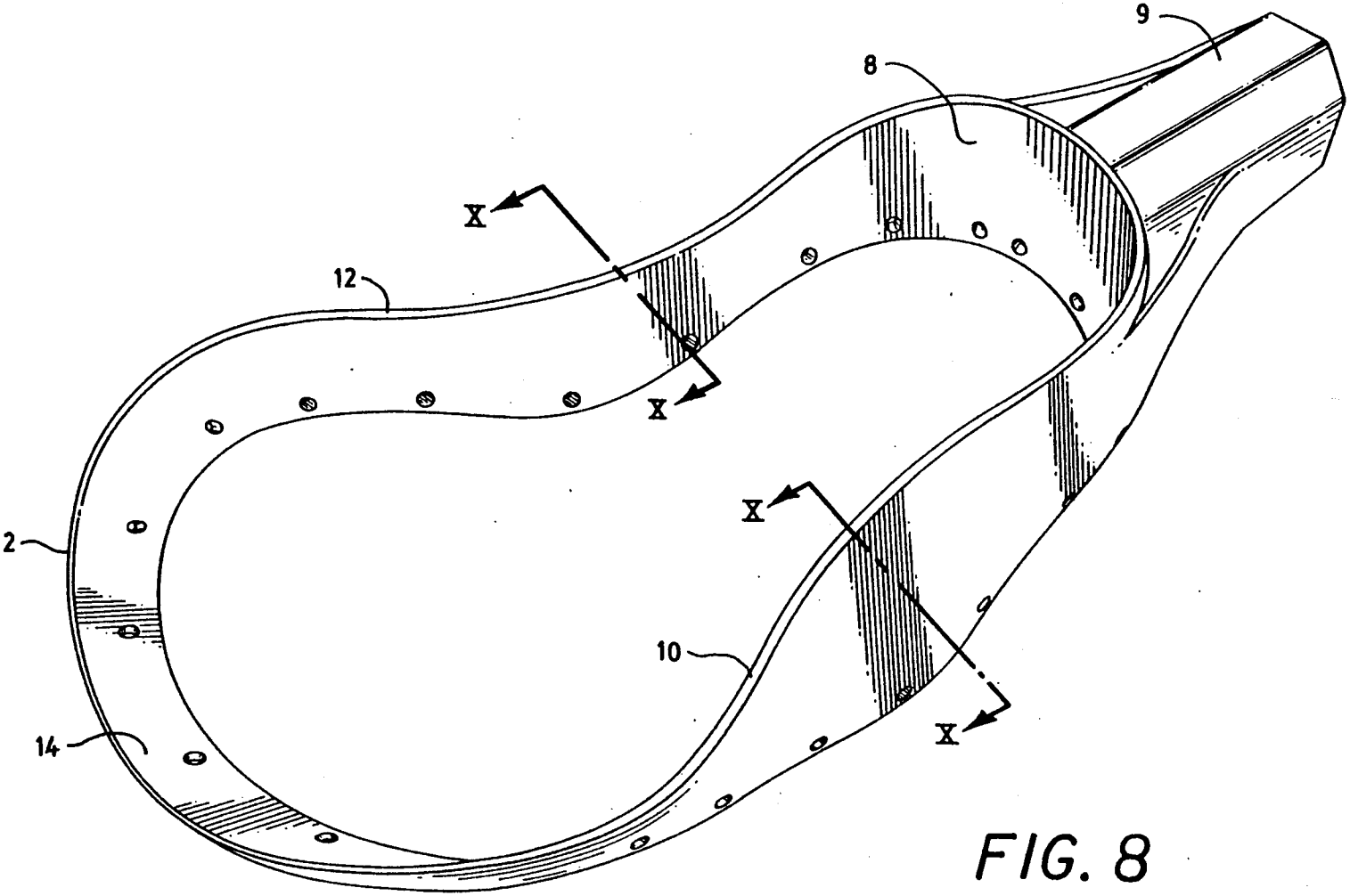
FIG. 8 is a perspective view of a still further alternative form of lacrosse stick head frame, illustrative of a still further alternative embodiment of the invention.
Figure 9:
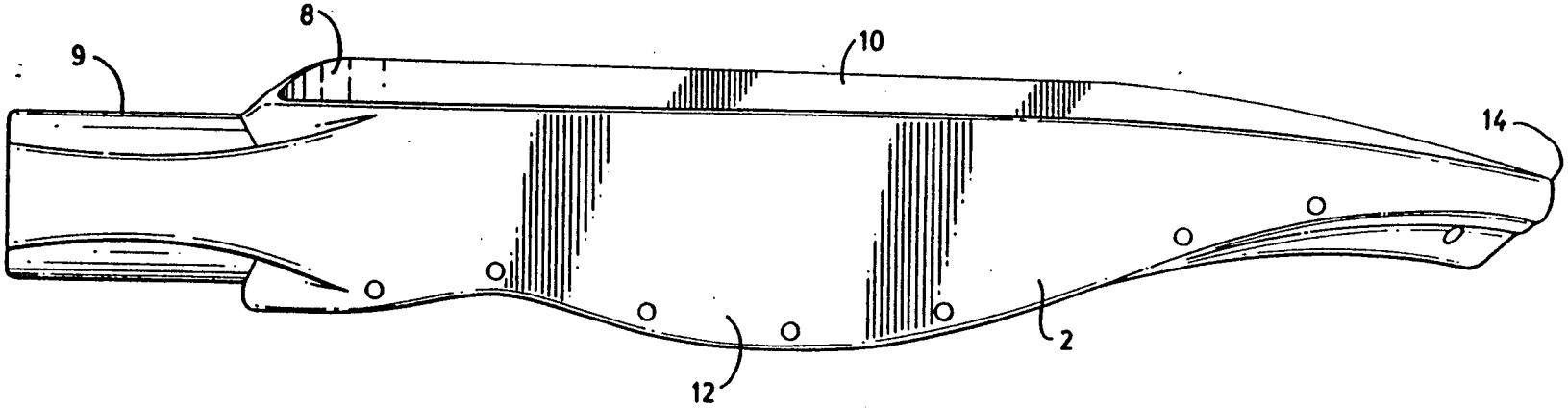
FIG. 9 is a side elevational view of the lacrosse stick head frame shown in FIG. 8.
Figure 10:
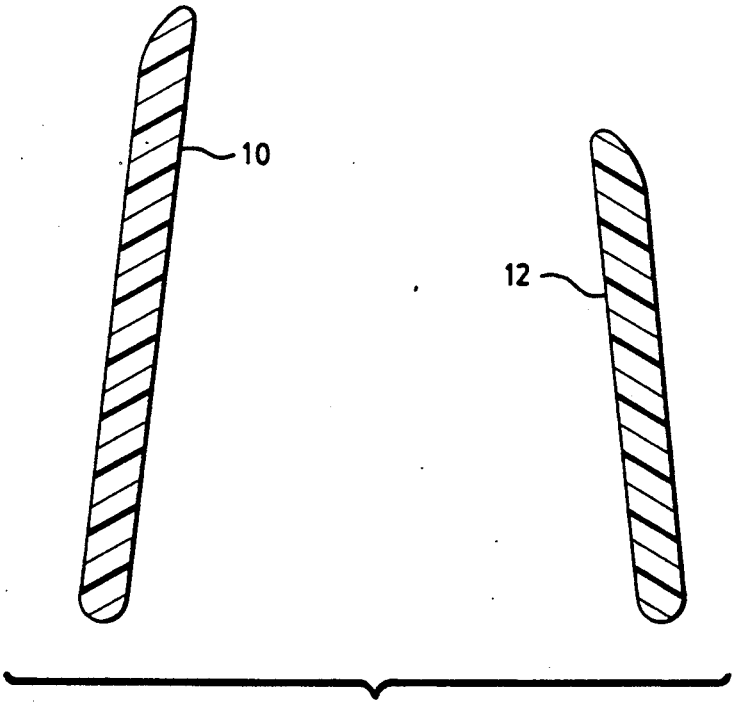
FIG. 10 is a sectional view of side wall portions of the head frame, taken along line X—X of FIG. 8.
Figure 11:
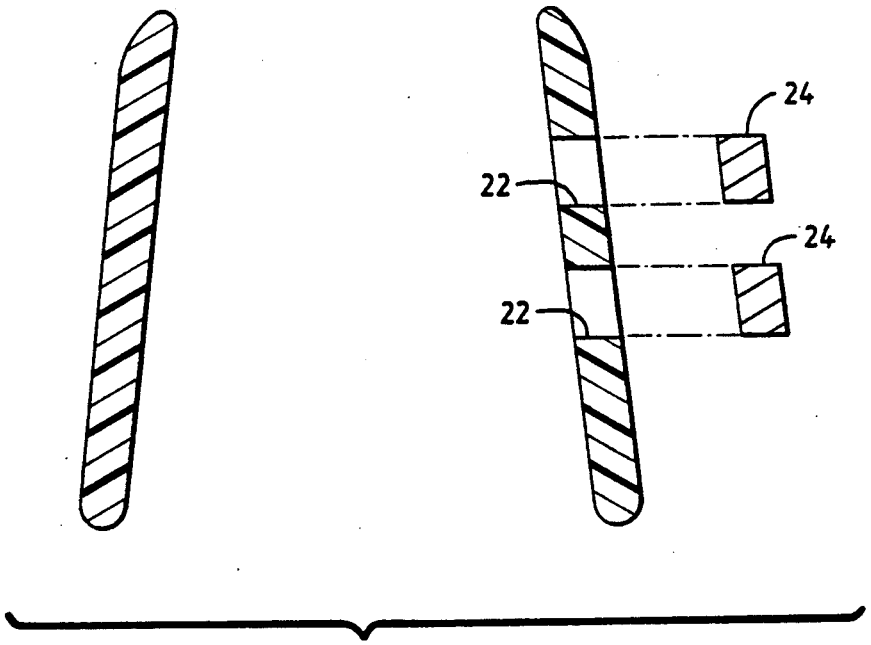
FIG. 11 is a sectional view of side wall portions, similar to FIG. 7, but showing alternative embodiments.

In accordance with a still further embodiment of the invention, illustrated in FIGS. 8–10, the first side wall 10 is provided with greater surface area than is the second side wall 12, permitting concentration of more forming material in the more rigid first side wall 10. In the drawings, there is shown an embodiment in which the surface area of one wall exceeds the surface area of the second wall by being of greater outside dimension than the second wall. Alternatively, the second wall 12 may be of the same outside dimension as the first wall 10, but provided with holes, recesses, slots, or the like 22 (FIG. 11), which reduce the surface area of the second wall relative to the solid, or more solid first wall 10. In a further alternative embodiment, such holes, recesses or slots 22 may be adapted to receive fillers or inserts 24 (FIG. 11) which provide stiffening means to a selected side wall. The inserts may also have the further advantage of providing an attractive design or cosmetic effect on the appearence of the frame. Such stiffeners 24 may be added selectively such that the stick handle obtains the desired stiffness by adding a particular number of stiffeners.

In still another alternative embodiment, the side walls may be adapted to receive only one or two inserts, or stiffeners 24, but the inserts themselves have different degrees of stiffness, such that by selection of a proper insert, or inserts, the stick handle may attain the degree of stiffness, or rigidity, desired.

It will be apparent that the above described rigidity-improving features may be used in various combinations. For example, the more rigid first wall may be molded thicker, larger in area, with reinforcing rib means, and of a more rigid material than the second side wall, though such might result in a relatively unbalanced head, depending upon the degrees of reinforcement by each feature. More likely is a combination of two features, such as more rigid material in combination with rib means.

However the above-described elements are combined, or if simply used solely, the result is a lacrosse stick head frame of asymmetrical rigidity in the two side walls, including one wall sufficiently rigid to cope with the pressures of face-off situations.

It is to be understood that the present invention is by no means limited to the particular constructions herein disclosed and/or shown in the drawings. but also comprises any modifications or equivalents within the scope of the claims.

Having thus described our invention, what we claim as new and desire to secure by Letters Patent of the United States is:

1. A lacrosse stick head comprising a frame and netting attached to said frame, said frame comprising a throat portion, first and second side walls extending divergently from said throat portion, and a lip portion joined to ends of said walls remote from said throat portion, said first side wall having structure rendering said first side wall substantially more rigid than said second side wall.

2. The lacrosse stick head in accordance with claim 1 in which said structure comprises said first side wall being substantially thicker than said second side wall.

3. The lacrosse stick head in accordance with claim 2 in which said frame is of molded plastic and said first side wall is molded thicker than said second side wall.

4. The lacrosse stick head in accordance with claim 1 in which said structure comprises reinforcing rib means provided on said first side wall.

5. The lacrosse stick head in accordance with claim 2 in which said structure further comprises reinforcing rib means provided on said first side wall.

6. The lacrosse stick head in accordance with claim 4 in which said rib means on said first side wall substantially exceeds in reinforcing facility second rib means on said second side wall.

7. The lacrosse stick head in accordance with claim 4 in which said second side wall is substantially devoid of reinforcing rib means.

8. The lacrosse stick head in accordance with claim 1 in which said structure comprises a more rigid material forming said first side wall than material forming said second side wall.

9. The lacrosse stick head in accordance with claim 2 wherein said structure further comprises a more rigid material forming said first side wall than material forming said second side wall.

10. The lacrosse stick head in accordance with claim 5 wherein said structure further comprises a more rigid material forming said first side wall than material forming said second side wall.

11. The lacrosse stick head in accordance with claim 8 wherein said frame is of molded plastic and said first side wall is molded of more rigid plastic than said second side wall.

12. The lacrosse stick head in accordance with claim 3 wherein said first side wall is molded of more rigid plastic than said second side wall.

13. The lacrosse stick head in accordance with claim 1 wherein said structure comprises said first wall having greater surface area than said second wall.

14. The lacrosse stick head in accordance with claim 2 wherein said structure further comprises said first wall having greater surface area than said second wall.

15. The lacrosse stick head in accordance with claim 4 wherein said structure further comprises said first wall having greater surface area than said second wall.

16. The lacrosse stick head in accordance with claim 5 wherein said structure further comprises said first wall having greater surface area than said second wall.

17. The lacrosse stick head in accordance with claim 8 wherein said structure further comprises said first wall having greater surface area than said second wall.

18. The lacrosse stick head in accordance with claim 9 wherein said structure further comprises said first wall having greater surface area than said second wall.

19. The lacrosse stick head in accordance with claim 10 wherein said structure further comprises said first wall having greater surface area than said second wall.

20. The lacrosse stick head in accordance with claim 11 wherein said structure further comprises said first wall having greater surface area than said second wall.

21. The lacrosse stick head in accordance with claim 4 wherein said structure further comprises a more rigid material forming said first side wall than material forming said second side wall.

22. The lacrosse stick head in accordance with claim 1 wherein at least one of said walls is provided with recess means therein, and said structure comprises insert means adapted to be retained in said recess means to increase rigidity of said wall.

* * * * *